US012398723B2

(12) United States Patent
Wang

(10) Patent No.: US 12,398,723 B2
(45) Date of Patent: Aug. 26, 2025

(54) INTEGRATED INFLATING AND DEFLATING PUMP

(71) Applicant: Boluo Futian Fumao plastic hardware products Co., Ltd., Guangdong (CN)

(72) Inventor: Qihao Wang, Dongguan (CN)

(73) Assignee: Boluo Futian Fumao plastic hardware products Co., Ltd., Guangdong (CN)

( * ) Notice: Subject to any disclaimer, the term of this patent is extended or adjusted under 35 U.S.C. 154(b) by 33 days.

(21) Appl. No.: 18/530,391

(22) Filed: Dec. 6, 2023

(65) Prior Publication Data

US 2025/0172154 A1 May 29, 2025

(30) Foreign Application Priority Data

Nov. 28, 2023 (CN) ..... 202323253740.X

(51) Int. Cl.
*F04D 17/16* (2006.01)
*F04D 25/02* (2006.01)
*F04D 25/06* (2006.01)

(52) U.S. Cl.
CPC ..... *F04D 17/16* (2013.01); *F04D 25/02* (2013.01); *F04D 25/06* (2013.01)

(58) Field of Classification Search
CPC ..... F04D 25/06; F04D 25/02; F04D 17/16; F04D 17/08; F04D 15/0005; F04D 15/0011; F04D 15/0016; F04D 15/0022; F04D 29/503; F04D 29/50
See application file for complete search history.

(56) References Cited

U.S. PATENT DOCUMENTS

| | | | | |
|---|---|---|---|---|
| 8,894,390 | B2 | 11/2014 | Hsu | |
| 2004/0123396 | A1* | 7/2004 | Wang | F04D 25/084 5/713 |
| 2005/0079077 | A1* | 4/2005 | Tsai | F04D 25/084 417/423.15 |
| 2006/0204361 | A1 | 9/2006 | Xie | |
| 2012/0304391 | A1 | 12/2012 | Driscoll, Jr. | |
| 2020/0400150 | A1* | 12/2020 | Huang | F04D 29/601 |
| 2024/0309880 | A1* | 9/2024 | Zeng | F04D 25/068 |

* cited by examiner

*Primary Examiner* — Courtney D Heinle
*Assistant Examiner* — Andrew Thanh Bui

(57) ABSTRACT

An integrated inflating and deflating pump includes an outer cylinder, a one-way valve mechanism arranged at a bottom of the outer cylinder, and an inflating and deflating mechanism placed in the outer cylinder in a forward or reverse direction; the outer cylinder is connected to a product to be inflated or deflated; the inflating and deflating mechanism has an air inlet; when the inflating and deflating mechanism is placed in the forward direction, the air inlet is close to the product, the one-way valve mechanism seals the outer cylinder, the inflating and deflating mechanism deflates the product; when the inflating and deflating mechanism is placed in the reverse direction, the air inlet is close to the one-way valve mechanism, the one-way valve mechanism is opened, the outer cylinder is in communication with the outside, and the inflating and deflating mechanism inflates the product.

9 Claims, 10 Drawing Sheets

INTEGRATED INFLATING AND DEFLATING PUMP

FIELD OF THE INVENTION

The present invention relates to the technical field of pumps, particularly, to an integrated inflating and deflating pump.

BACKGROUND OF THE INVENTION

An air pump is a device for inflating and deflating a closed space and includes an electric air pump, a manual air pump, a foot-driven air pump and an electric air pump. The electric air pump uses electric power to continuously compress air to generate air pressure. It is mainly used for gas spraying, sewage treatment, electroplating blast, biogas digester aeration, tunnel ventilation, etc.

Chinese Utility Model CN200820084334.1 discloses a bidirectional inflating and deflating pump, which includes a piston and an axle core. The piston is composed of a piston ring, a beam ring, a sealing sheet, and two unidirectional valve sheets. The piston ring has two openings, an air inlet chamber and an air outlet chamber are provided inside the piston, the two unidirectional valve sheets are respectively provided above and below the air inlet chamber, and two sealing sheets are respectively provided at the openings of the two unidirectional valve sheets. The axle core is provided with a partition to divide itself into two chambers, one is an air inlet channel and the other is an air outlet channel, the upper and lower ends of the air inlet channel and the air outlet channel are respectively provided with notches, the notches at the upper end are respectively in communication with an air inlet and an air outlet at a grip, and the notches at the lower ends are respectively in communication with the air inlet chamber and the air outlet chamber of the piston ring. The ventilation structure of the technical scheme in the utility model is simpler, has fewer parts, is more convenient for maintenance, and has more stable performance. However, it is necessary to provide the air inlet chamber and the air outlet chamber to achieve bi-directional inflation and deflation. The product has a large volume and a complex structure.

Chinese Utility Model CN200820145501.9 discloses an inflating and deflating pump, which includes a pump base and a pump, a partition is provided inside the pump base to divide it into an outer chamber and an inner chamber. The outer chamber is provided with a gas port in communication with the outside, and the side wall thereof is provided with a ventilation hole having a one-way valve in communication with the interior of a balloon. The air pump is arranged in the inner chamber, the partition is provided with an inlet hole and an outlet hole. The outer chamber is provided with a gas exchange valve comprising a valve seat, a valve core, and a reset spring. The valve seat is provided with an air inlet chamber and an air outlet chamber, the air inlet chamber is in communication with the inlet hole, and the wall thereof is provided with an inner airport and an outer airport, respectively in communication with the outer chamber and the airport. The air outlet chamber is in communication with the outlet port, and the wall thereof is provided with an inner airport and an outer airport, respectively in communication with the outer chamber and the airport. The valve core passes through each gas port of the valve base, and three seals are provided thereon to be opposite to each gas port. The inflating and deflating pump uses an electromagnetic valve group to control the valve core of the gas exchange valve to convert inflation and deflation, and can control the action of the electromagnetic valve group when a motor is started, completely automated.

Most of these air pumps in the prior art are of an integrated design. The air pumps are inconvenient to be disassembled. When the air pumps are damaged, the whole devices are discarded, and the structure is complicated and the production cost is high. For this reason, it is necessary to develop an integrated inflating and deflating pump that is convenient to disassemble.

SUMMARY OF THE INVENTION

In order to overcome the deficiencies of the prior art, the present disclosure provides an integrated inflating and deflating pump to overcome the deficiencies that the pumps in the prior art are inconvenient to assemble and disassemble, using an inflating and deflating mechanism which can be placed in a forward direction and a reverse direction, the functions of inflation and deflation are converted, and the assemble and the disassemble are convenient.

The technical scheme of the present disclosure are as follows: an integrated inflating and deflating pump, which includes an outer cylinder, a one-way valve mechanism arranged at the bottom of the outer cylinder, and an inflating and deflating mechanism placed in the outer cylinder in a forward or reverse direction; the outer cylinder is connected to a product to be inflated or deflated; the inflating and deflating mechanism has an air inlet; when the inflating and deflating mechanism is placed in the forward direction, the air inlet is close to the product, the one-way valve mechanism seals the bottom of the outer cylinder, the inflating and deflating mechanism extracts air from the products to achieve deflation; when the inflating and deflating mechanism is placed in the reverse direction, the air inlet is close to the one-way valve mechanism, the one-way valve mechanism is opened, the outer cylinder is in communication with the outside, and the inflating and deflating mechanism fills the product with air from the outside to achieve inflation.

The bottom surface of the outer cylinder protrudes inwards to form a first inserted tube, the one-way valve mechanism is mounted in the first inserted tube and comprises a sealing pad, sealed and connected to the first inserted tube so as to seal the outer cylinder, or disengaged from the first inserted tube so as to open the outer cylinder.

The one-way valve mechanism further comprises a mounting seat, a valve tube, a valve cover, a valve rod, and a spring. The mounting seat is connected with the first inserted tube by several connecting ribs, the valve tube extends into the outer cylinder through the mounting seat in a sliding manner, a first end of the valve tube is plugged with the valve cover, and a second end of the valve tube is plugged with the valve rod; an end of the valve rod is provided with the sealing pad, and the valve tube is sleeved with the spring; and one end of the spring abuts against the mounting seat, and the other end thereof abuts against the valve cover.

The second end of the valve tube laterally extends several ribs to connect with a circle, when the sealing pad abuts against the ribs and the circle, it is blocked from continuing to move.

The valve rod is provided with a limiting ring, the second end of the valve tube is provided with a through hole for the valve rod to pass through, the outer diameter of the limiting ring is bigger than the inner diameter of the through hole, when the valve rod moves until the limiting ring abuts against the through hole, the limiting ring is blocked by the second end of the valve tube and cannot be detached from the through hole, thereby preventing the valve rod from falling out of the valve tube.

The inflating and deflating mechanism includes an inner cylinder comprising the first cylinder and the second cylinder that are interlocked with each other.

The bottom surface of the first cylinder is provided with a first fitting tube, the top surface of the second cylinder is provided with an air inlet tube, the opening of the air inlet tube is the air inlet, airflow enters and exits the inner cylinder through the air inlet tube.

The inflating and deflating mechanism further comprises a motor barrel, a motor and, a blade assembly. The motor barrel is accommodated in the first cylinder, the motor is mounted in the motor barrel, and a second fitting cylinder is provided at the bottom of the motor barrel; a second plug-in cylinder is provided in the first cylinder, the second fitting cylinder is inserted into the second plug-in cylinder, and a first sealing ring is provided therebetween for sealing connection; the top of the motor cylinder is provided with a top cover, and the periphery of the top cover extends towards the top surface of the second cylinder and is fixedly connected thereto so as to form a blade chamber; the blade assembly is accommodated in the blade chamber; and a rotating shaft of the motor penetrates through the top cover and used for mounting the blade assembly.

The blade assembly includes a mounting board, the center of the mounting board is provided with an airflow hole, a mounting shaft is arranged in the airflow hole. The bottom surface of the mounting board is uniformly provided with several fan blades, the blades connect with the mounting shaft, and the mounting shaft is fixed on the rotating shaft of the motor.

When the inflating and deflating mechanism is placed in the outer cylinder in the forward direction, the first fitting tube is inserted into the first inserted tube, a second sealing ring is arranged between the outer wall of the first fitting tube and the inner wall of the first inserted tube to connect them in a sealing manner. The inner wall of the lid of the outer cylinder is provided with a reinforcing ring, an upper edge of the air inlet tube is inserted in the reinforcing ring, and a gap is provided between the reinforcing ring and the upper edge of the air inlet tube so that the outer cylinder is in communication with the inner cylinder; the airflow hole directly faces the air inlet tube; and the motor rotates to drive the blade assembly to rotate, so as to extract air from the product to be deflated.

A limiting ring is provided in the air inlet tube, and the limiting ring is laterally provided with a plurality of side ribs connected to the air inlet tube. When the inflating and deflating mechanism is placed in the outer cylinder in the reverse direction, the air inlet tube is inserted into the first inserted tube, and the limiting ring pushes the valve cover, thereby pushing the valve tube away from the valve cover so that the sealing pad on the second end of the valve tube moves away from the first inserted tube, thereby opening the first inserted tube. When the motor rotates and drives the blade assembly to rotate, the air from the outside is sucked into the outer cylinder and inflated into the product to be inflated.

An air pressure display screen is arranged between the inner cylinder and the motor cylinder, and the inner cylinder is provided with a transparent window at a position directly opposite to the air pressure display screen, thereby facilitating to observe an air pressure condition in the inner cylinder.

The advantages of the present disclosure are as follows: The integrated inflating and deflating pump according to the present disclosure is provided with the inflating and deflating mechanism and the one-way valve mechanism. The inflating and deflating mechanism is installed in the outer cylinder in a forward direction or a reverse direction to convert the inflating and deflating function. The inflating and deflating mechanism is convenient to disassemble and assemble.

In the integrated inflating and deflating pump in the present disclosure, the top of the outer cylinder is connected to the product to be inflated or deflated, and the bottom of the outer cylinder is provided with the one-way valve mechanism. The one-way valve mechanism seals the bottom of the outer cylinder, and the inflating and deflating mechanism is placed in the forward direction to extract air from the product. The inflating and deflating mechanism is placed in the reverse direction, and the one-way valve mechanism is opened and is in communication with the outside so that air in the outside is sucked into the outer cylinder and inflated into the product to be inflated.

After the inflating and deflating mechanism is damaged, it is directly detached from the outer cylinder and then repaired or replaced, thereby saving resources and reducing costs.

EMBODIMENTS

Figure 1:
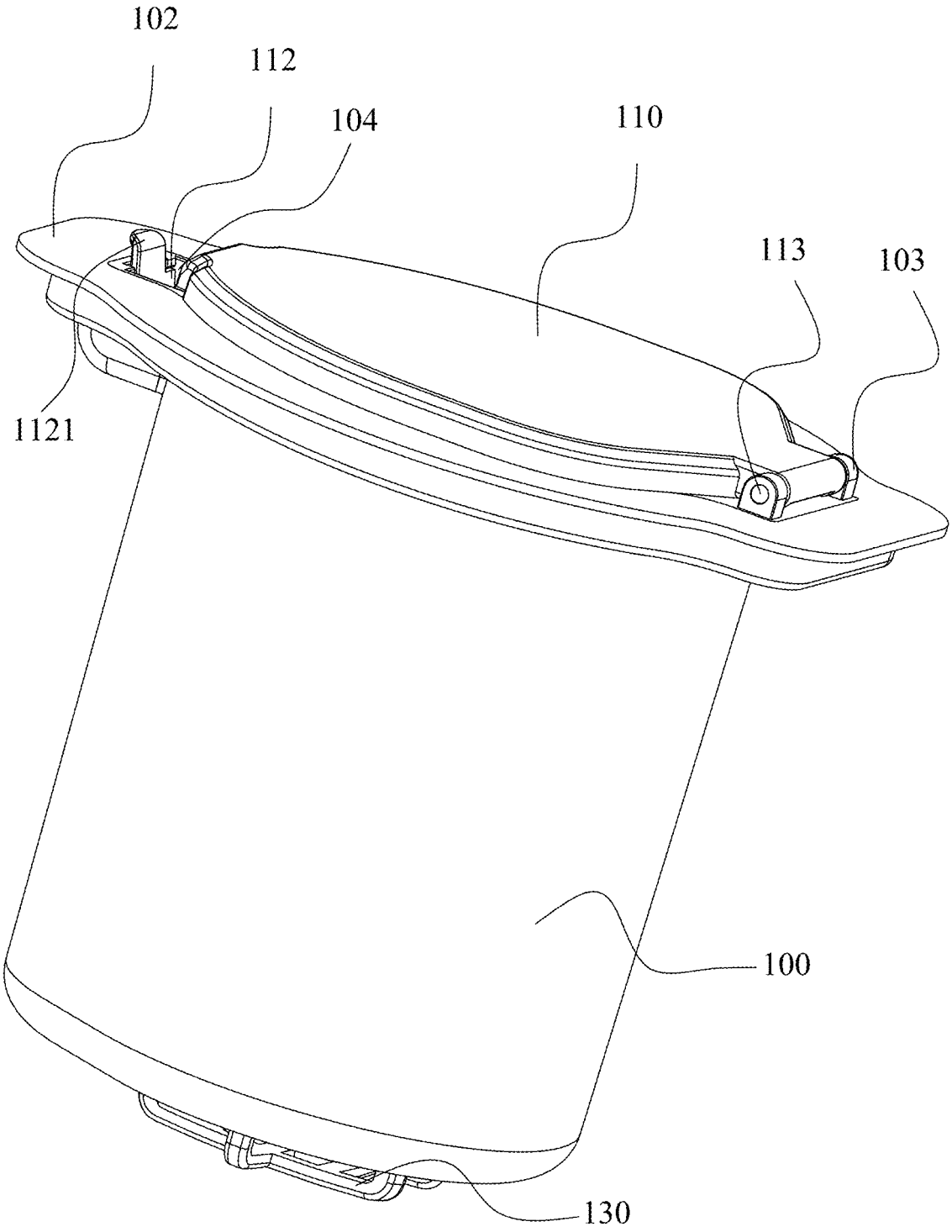
FIG. 1 is a perspective view of an exemplary integrated inflating and deflating pump according to an embodiment of the present disclosure.

Embodiments of the present invention are described in detail below, and examples of the embodiments are shown in the attached drawings, in which the same or similar labels represent the same or similar elements or elements with the same or similar function. The embodiments described below by reference to the attached drawings are exemplary and are intended to explain embodiments of the present invention and cannot be understood as limits in the present invention.

Referring to FIGS. 1-10, an integrated inflating and deflating pump includes an outer cylinder 100, a lid 110 covering the top end 101*a* of the outer cylinder 100, a one-way valve mechanism 200 arranged at the bottom of the outer cylinder 200, and an inflating and deflating mechanism 300 placed in the outer cylinder 100 in a forward or reverse direction. The top end 101*a* of the outer cylinder 100 is connected to a product to be inflated or deflated, such as inflatable boats, swimming circles, tires, etc. The inflating and deflating mechanism 300 has an air inlet 301; when the inflating and deflating mechanism 300 is placed in the forward direction, the air inlet 301 is close to the product to be inflated or deflated, the inflating and deflating mechanism 300 extracts air from the product to achieve deflation; when the inflating and deflating mechanism is placed in the reverse direction, the air inlet 301 is close to the one-way valve mechanism 200, the one-way valve mechanism 200 is opened, the bottom of the outer cylinder 100 is in communication with the outside, and the inflating and deflating mechanism 300 fills the product with air from the outside to achieve inflation.

The lid 110 is pivotally connected to the top end 101*a* of the outer cylinder 100. The lid 110 is rotated to cover and seal the outer cylinder 100, and rotated in a reverse direction to open the outer cylinder 100. Specifically, opposite two edges of the lids 110 are respectively provided with a shaft hole 111 and a buckle 112. The top end 101*a* of the outer cylinder 100 extends laterally to form an ear edge 102, the opposite two sides of the ear edge 102 are equipped with a pair of installing poles 103 and a groove 104, a shaft 113 passes through the shaft hole 111, with both ends thereof are respectively arranged in the installing poles 103, thereby pivotally connecting the lid 110 to the shaft 113. The groove 104 and the buckle 112 are matched with each other, when the lid 110 covers the outer cylinder 110, the buckle 112 is accommodated in the groove 104 to fix the lid 110.

The lid 110 is provided with a sealing slot 114, the sealing slot 114 is equipped with a sealing ring 101, when the lid 110 covers the outer cylinder 100, the top end 101*a* of the outer cylinder 100 is squeezed into the sealing ring 101, thereby sealing and connecting the outer cylinder 100 and the lid 110.

Figure 2:
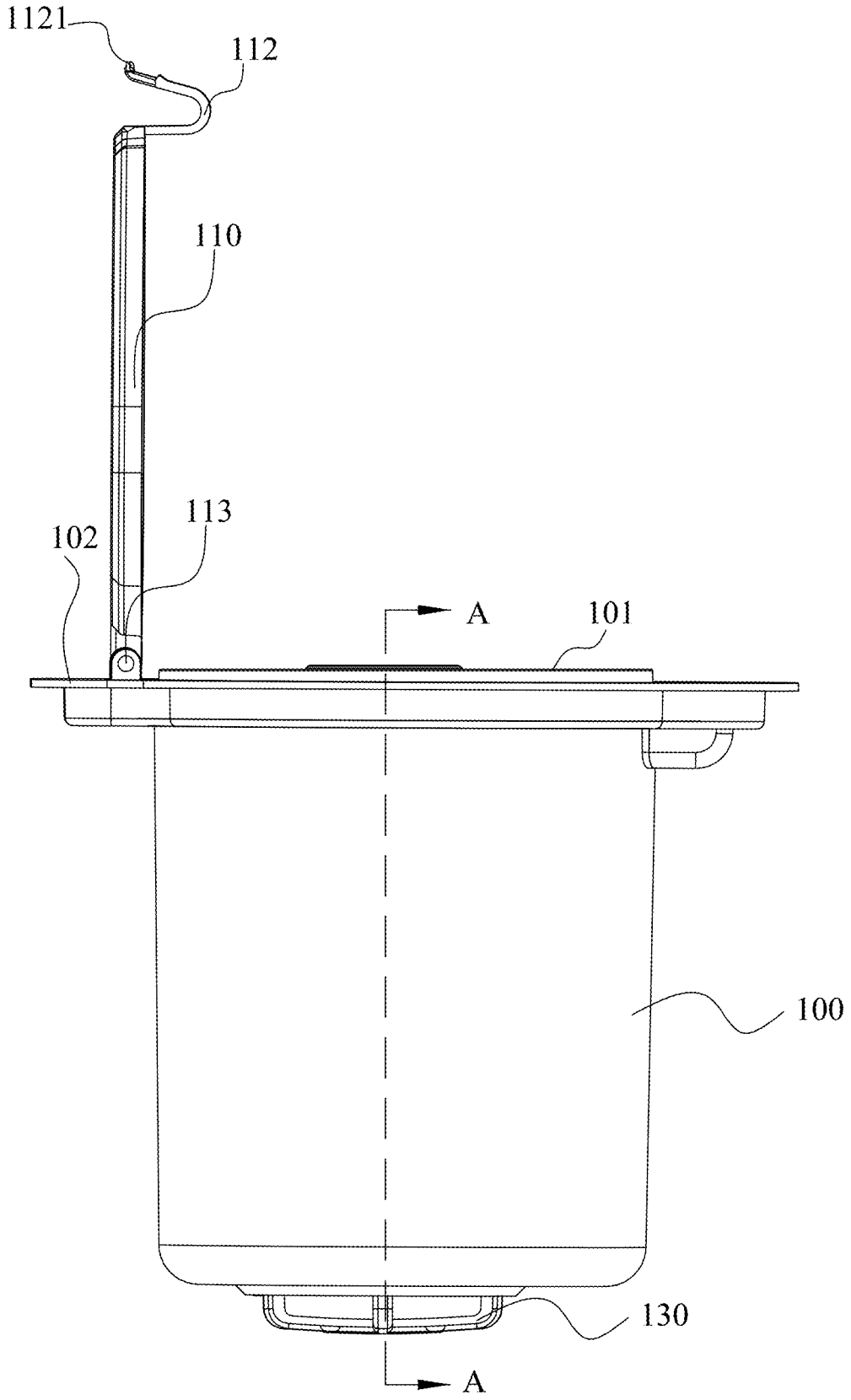
FIG. 2 is a front view of the integrated inflating and deflating pump of FIG. 1, the lid of the integrated inflating and deflating pump is opening.
Figure 3:
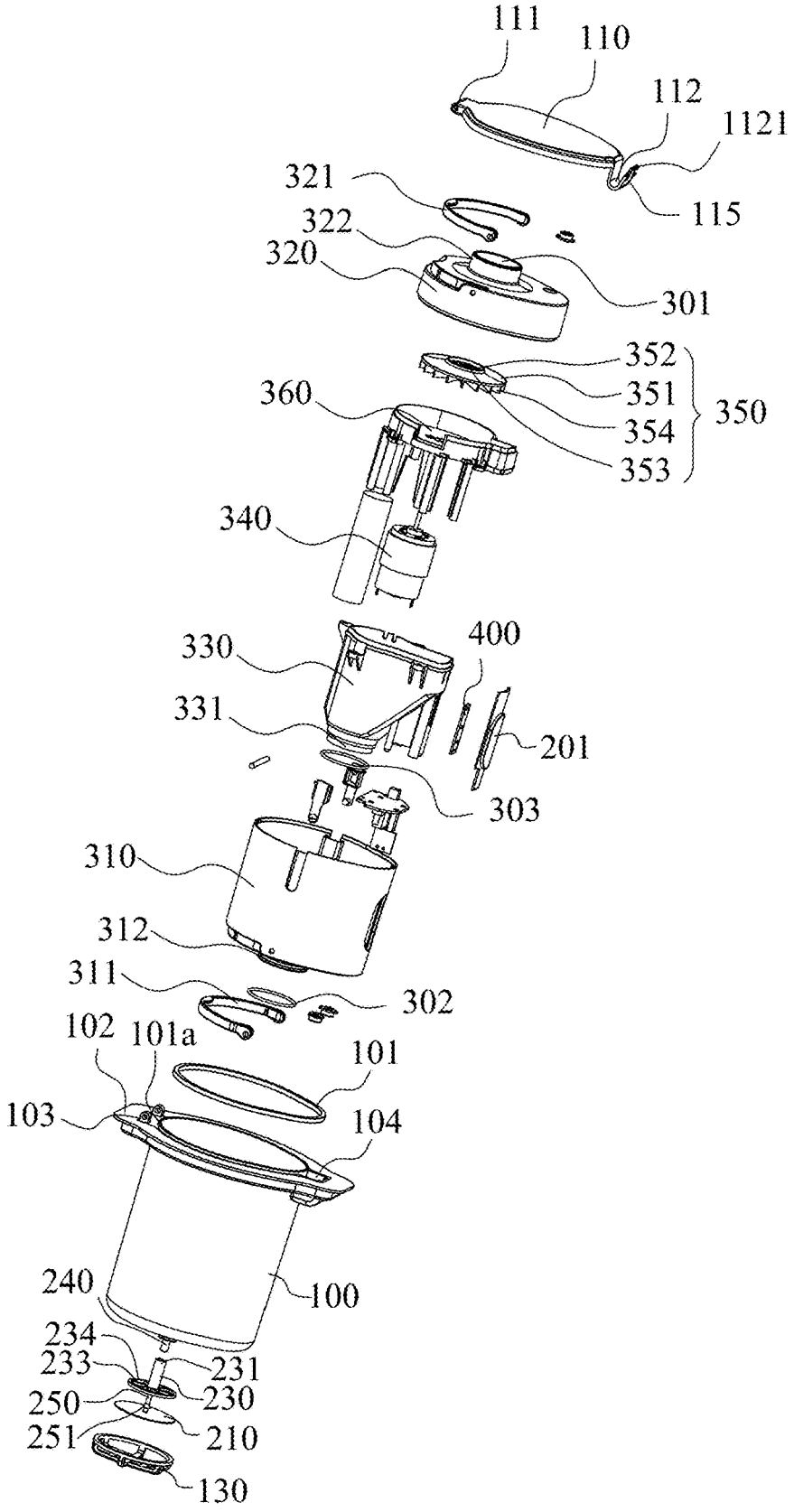
FIG. 3 is an exploded view of FIG. 1.
Figure 4:
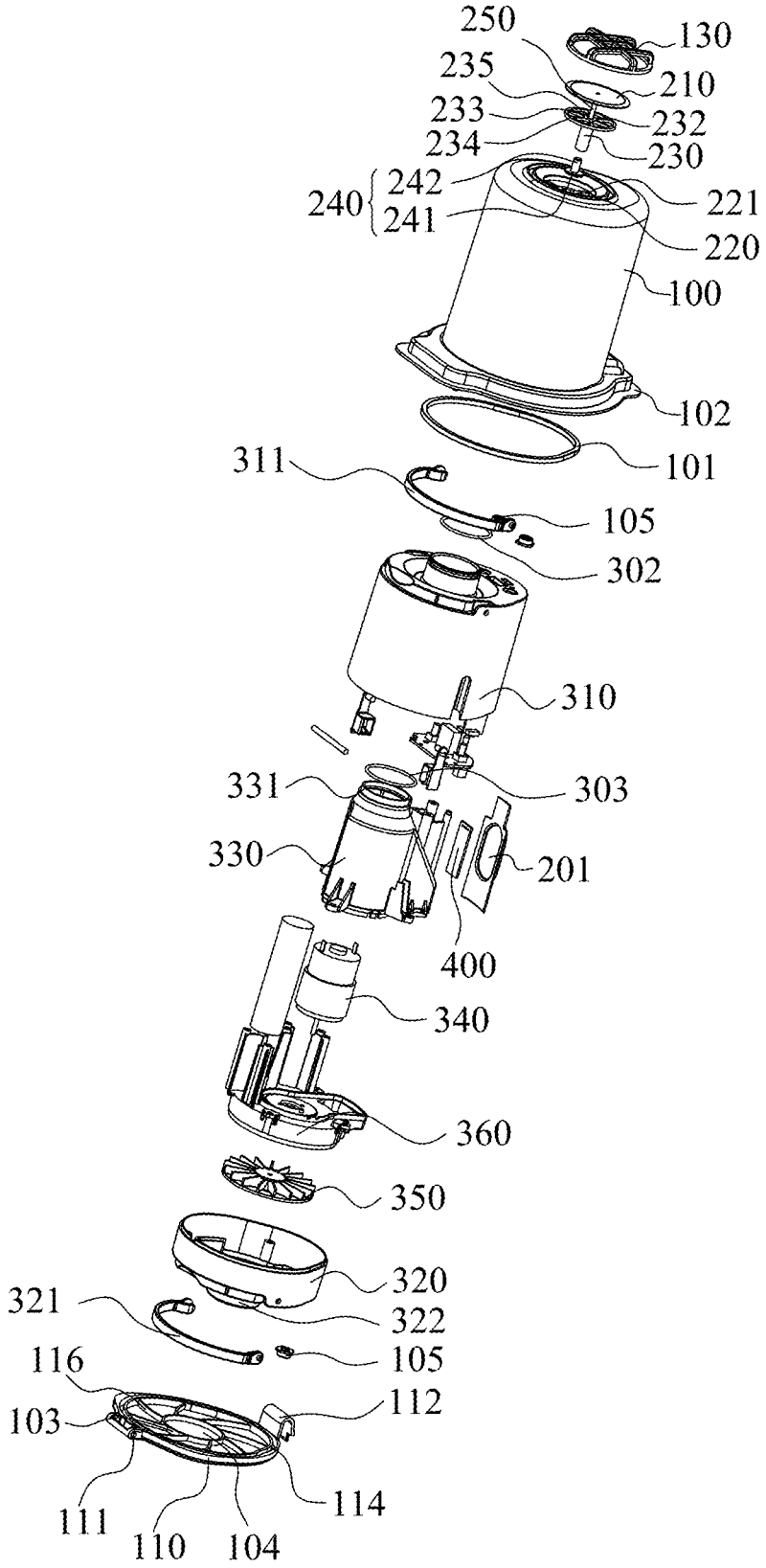
FIG. 4 is the exploded view in the other direction of FIG. 1.
Figure 7:
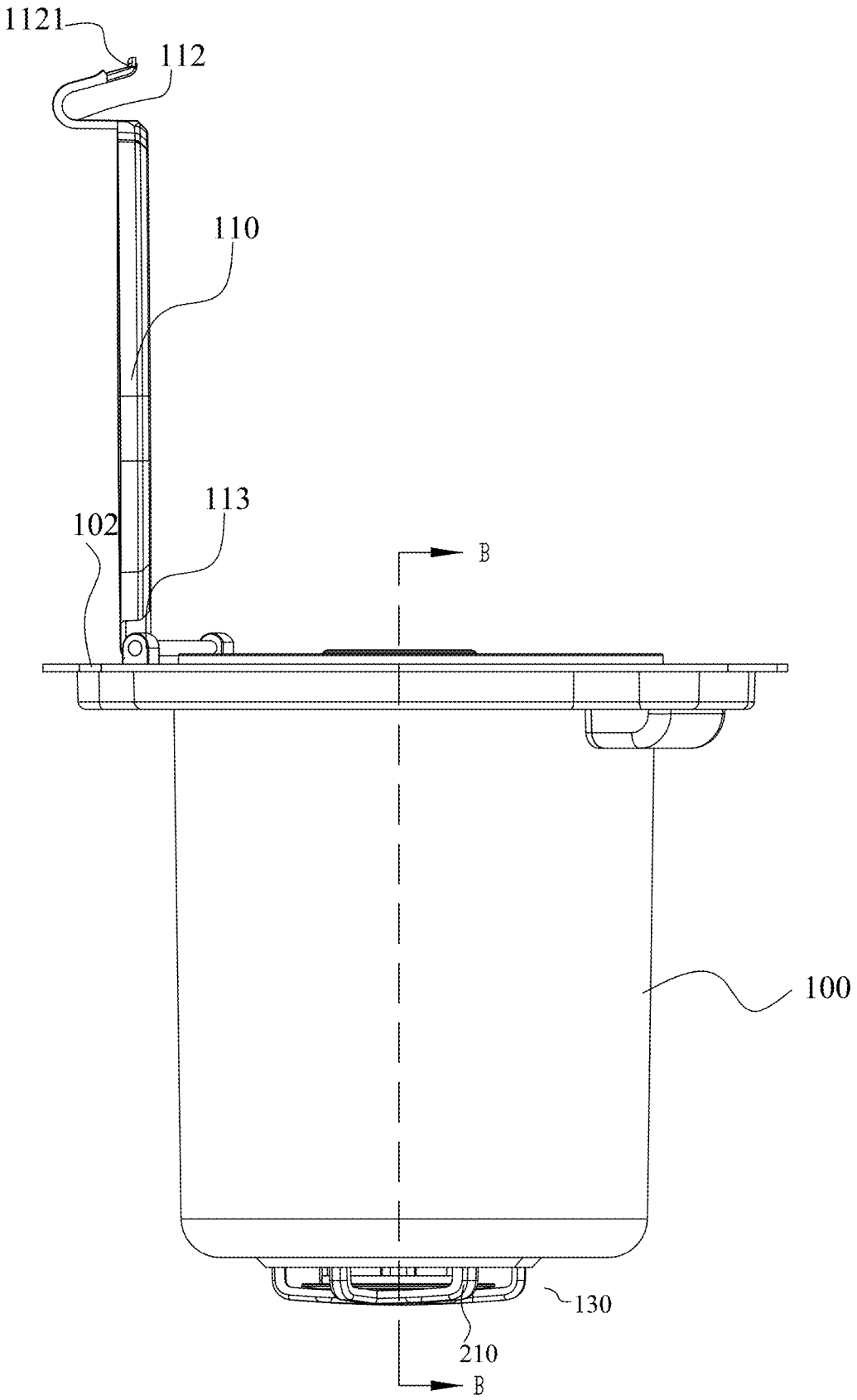
FIG. 7 is the front view of the FIG. 6.

As seen in FIG. 2 and FIG. 7, when the integrated inflating and deflating pump is used to inflate or deflate the product, the lid 110 is opened from the outer cylinder 100. The top end 101*a* of the outer cylinder 100 is connected with the product to be inflated and deflated, the sealing ring 101 also plays the function of sealing and connecting the outer cylinder 100 and the product to be inflated and deflated.

The buckle 112 is a U-shaped clip, with a free end protruding upward by a paddle 1121, and both sides of the free end respectively protruding outward to form protrusions 115. When the protrusions 115 enter the groove 104, the protrusions 115 abut against the wall of the buckle 112 to achieve interference fit so that the lid 110 and the outer cylinder 100 are fixedly connected, thereby preventing detachment.

The lid 110 is provided with several reinforcing ribs 116 at one side facing the outer cylinder 100, which increases the strength of the lid 110 and prevents excessive internal pressure in the outer cylinder 100 from blasting the lid 110.

The bottom surface of the outer cylinder 100 protrudes inwards to form the first inserted tube 120, and the one-way valve mechanism 200 is mounted in the first inserted tube 120. The one-way valve mechanism 200 controls the outer cylinder 100 in communication with the outside or not.

Specifically, the one-way valve mechanism 200 comprises a sealing pad 210, hermetically sealed the first inserted tube 120 so as to isolate the inner cavity of the outer cylinder 100 from the outside, or open the first inserted tube 120 so as to communicate the inner cavity of the outer cylinder 100 with the outside. When deflating the product, the inflating and deflating mechanism 300 extracts the air from the product, opens the sealing pad 210 by the wind pressure generated by the following blade assembly, thereby communicating the outer cylinder with the outside. When inflating the product, the inflating and deflating mechanism 300 opens the sealing pad 210, thereby communicating the outer cylinder with the outside.

The one-way valve mechanism 200 includes a mounting seat 220, a valve tube 230, a valve cover 240, a valve rod 250, and a spring 260. The mounting seat 200 is connected with the first inserted tube 120 by several connecting ribs 221, thereby fixing the mounting seat 220 in the first inserted tube 120. This hollow structural design facilitates the air in and out of the outer cylinder 100 on one hand and is used for installing the valve tube 230 described below on the other hand.

The mounting seat 220 is provided with a through hole 222, the valve tube 230 is mounted in the through hole 222. The first end 231 of the valve tube 230 is plugged with the valve cover 240. The valve cover 240 includes a cover body 241 and a rod 242, the cover 241 is located outside the first end 231 of the valve tube 230, and the rod 242 is inserted into the first end 231 of the valve tube 230. The second end 232 of the valve tube 230 is plugged with the valve rod 250. The end of the valve rod 250 is provided with the sealing pad 210, and the valve tube 230 is sleeved with the spring 260. One end of the spring 260 abuts against the mounting seat 220, and the other end thereof abuts against the cover body 241.

Figure 5:
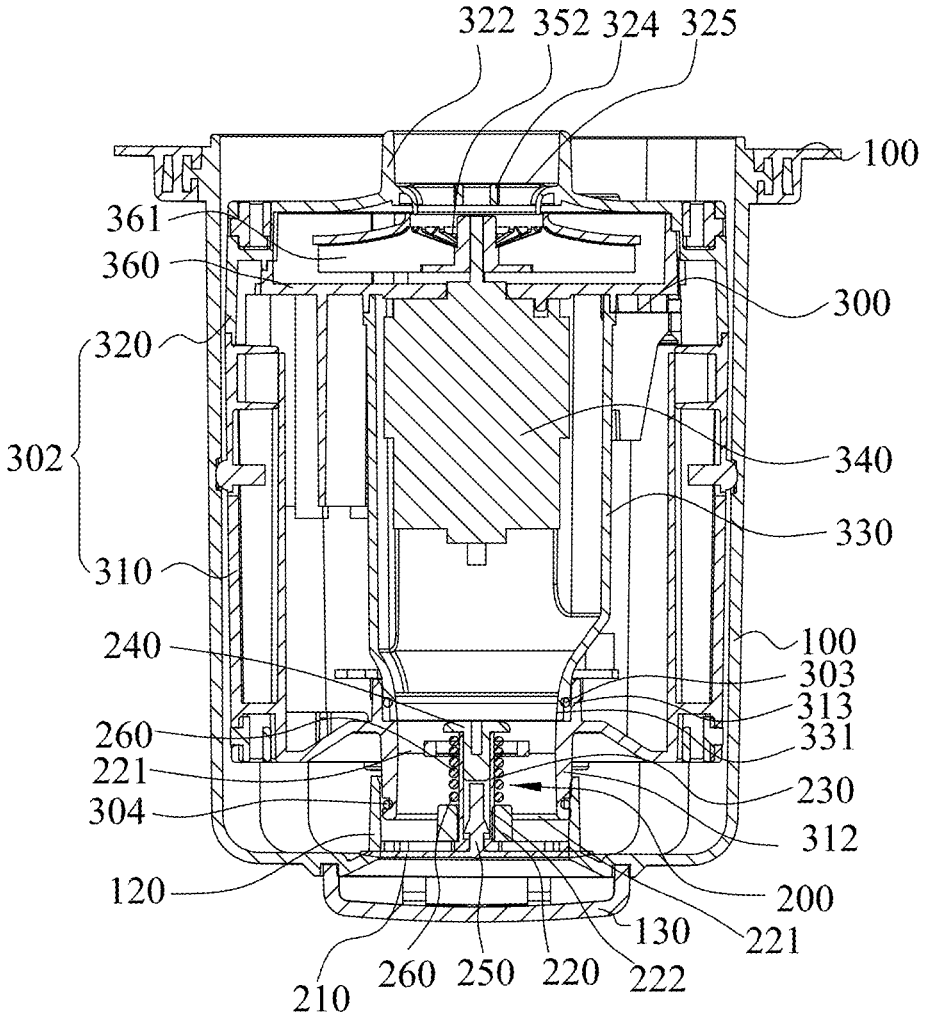
FIG. 5 is a section view along the A-A line in FIG. 2, in the view, the inflating and deflating mechanism is placed in a forward direction in the outer cylinder.
Figure 6:
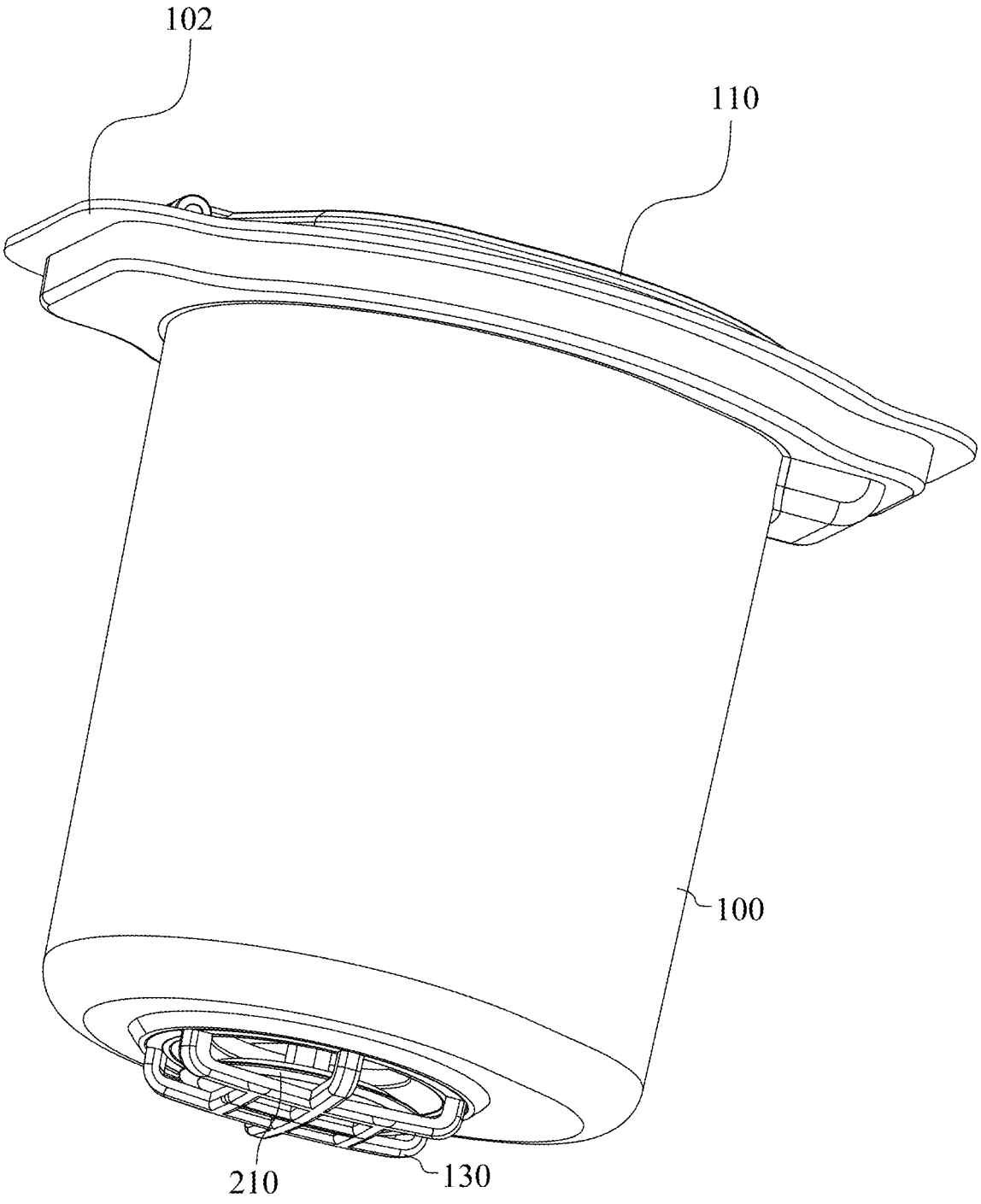
FIG. 6 is the other perspective view of the integrated inflating and deflating pump according to an embodiment of the present disclosure. This view shows the sealing pad in the one-way valve opens from the first plug-in barrel.

Referring to FIG. 5, when the integrated inflating and deflating pump is used to deflate the product, the inflating and deflating mechanism 300 is placed in the forward direction in the outer cylinder 100, the spring is in a naturally or almost naturally straight state. The cover 240 is pushed to move away from the sealing pad 210 by the spring 260, and the sealing pad 210 hermetically seals the first inserted tube 120. Preferably, the second end 232 of the valve tube 230 laterally extends several ribs 233 connecting with a circle 234. When the sealing pad 210 abuts against the ribs 233 and the circle 234, it is blocked by the ribs 233 and the circle 234, thereby defining the location of the sealing pad 210 in the first inserted tube 120.

Figure 8:
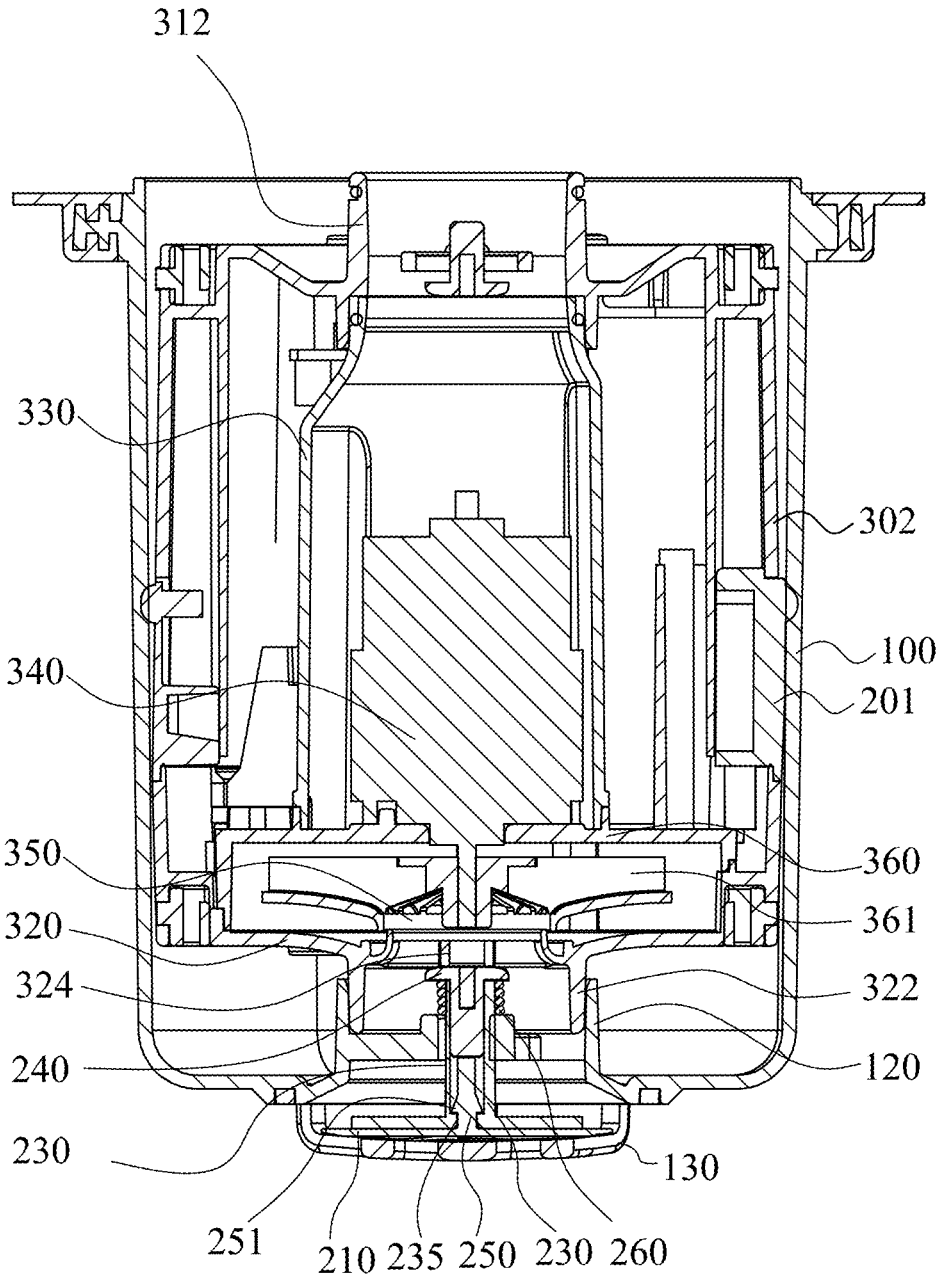
FIG. 8 is a section view along the B-B line in FIG. 6.
Figure 9:
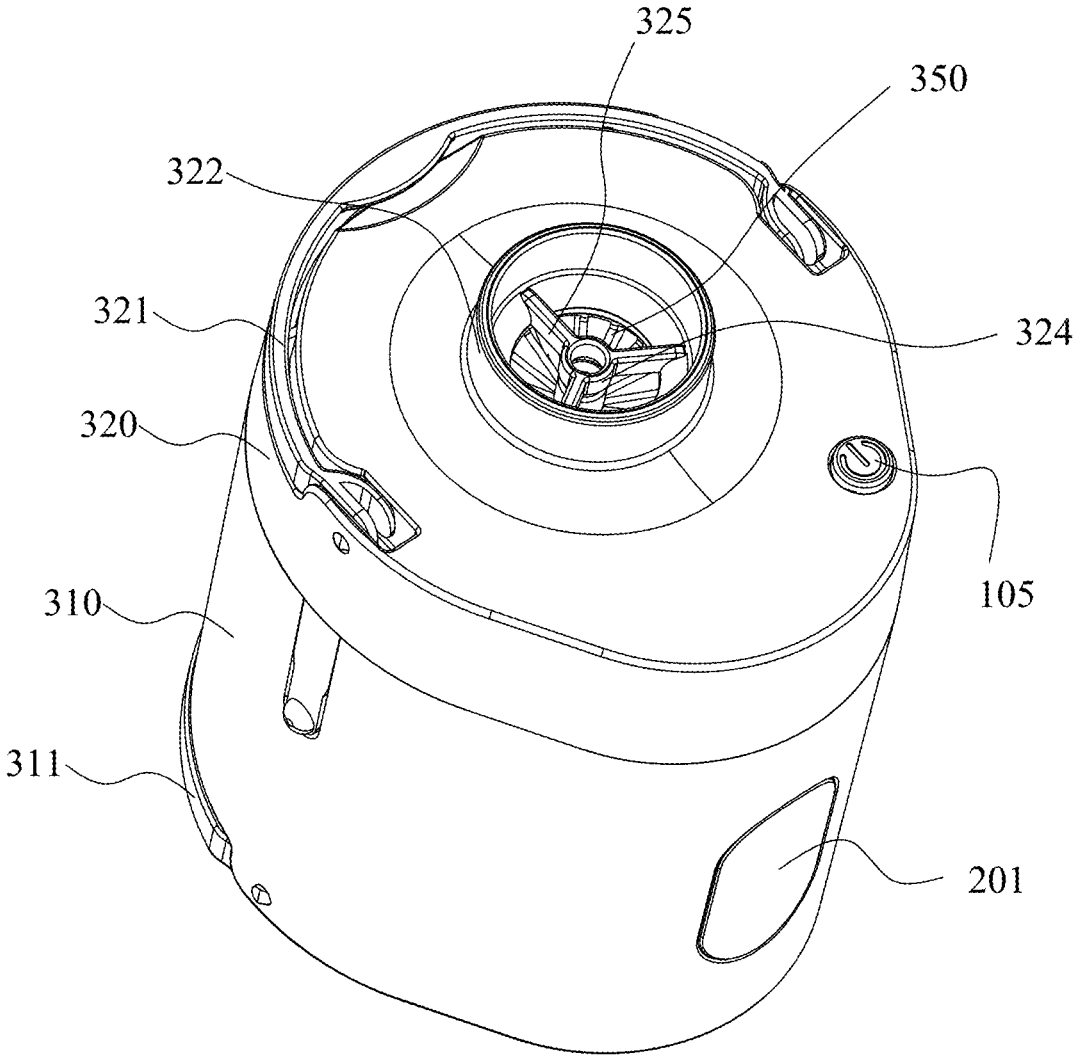
FIG. 9 is a perspective view of FIG. 1 after removing the outer cylinder 100 and the lid 110.
Figure 10:
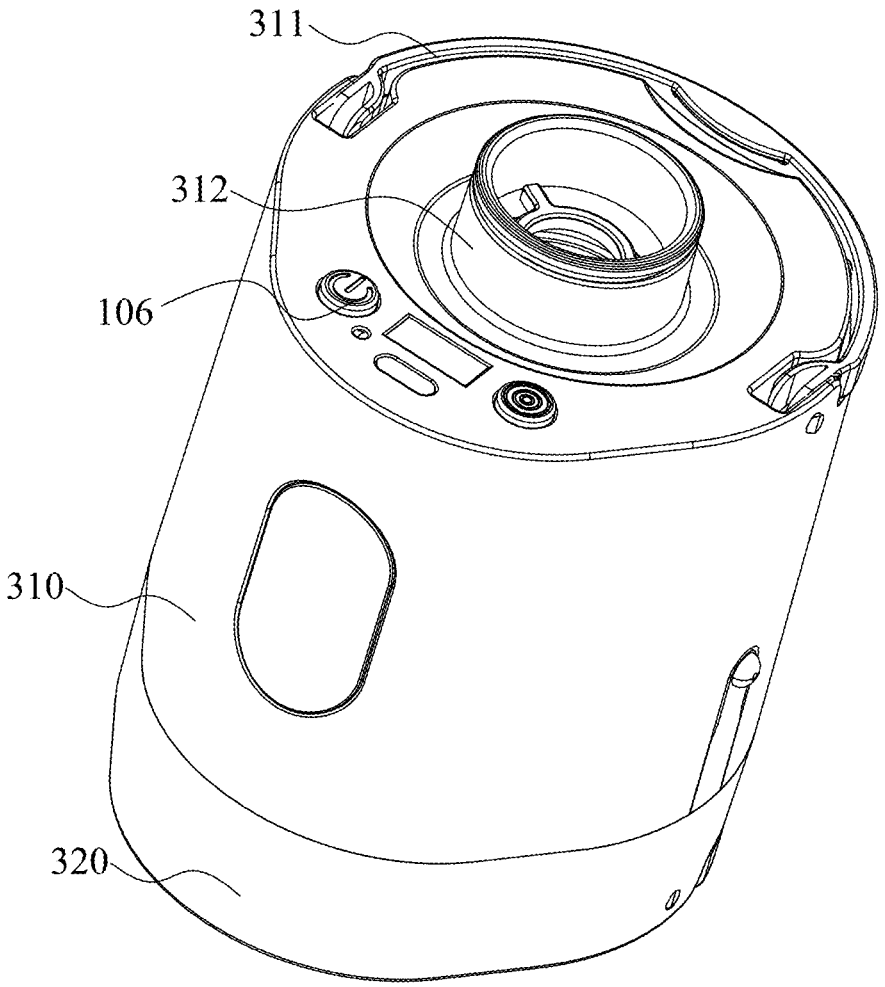
FIG. 10 is the perspective view in the other direction of FIG. 9.

Referring to FIG. 8, when the integrated inflating and deflating pump is used to inflate the product, the inflating and deflating mechanism 300 is placed in the reverse direction in the outer cylinder 100, and the inflating and deflating mechanism 300 pushes the valve cover 240 of the one-way valve mechanism 200 towards the bottom of the outer cylinder 100, the spring 260 is compressed, and the valve cover 240 pushes the valve rod 250 towards the bottom of the outer cylinder 100, and the valve rod 250 drives the sealing pad 210 to detach from the first inserted tube 120 so that the outer cylinder 110 is in communication with the outside.

The valve rod 250 is provided with a limiting ring 251, the second end 232 of the valve tube 230 is provided with a through hole 235 for the valve rod 250 to pass through, the outer diameter of the limiting ring 251 is bigger than the inner diameter of the through hole 235, when the valve rod 251 moves until the limiting ring 251 abuts against the through hole 235, the limiting ring 251 is blocked by the second end 232 and cannot be detached from the through hole 235, thereby preventing the valve rod 250 from falling out of the valve tube 230.

Preferably, a protective barrier 130 is fixed on the bottom surface of the outer cylinder 100, which is located outside the sealing pad 210 to protect the sealing pad 210 and the valve rod 250, preventing the valve rod 250 from being quickly pushed away from the first inserted tube 120.

After the inflation is finished, the inflating and deflating mechanism 300 is disassembled, the spring 260 pushes the valve cover 240 to reset by its elastic potential energy.

Referring to FIGS. 3-5 and 8-10, the inflating and deflating mechanism 300 includes an inner cylinder 302 comprising the first cylinder 310 and the second cylinder 320 that are interlocked with each other. The first cylinder 310 and the second cylinder 320 are respectively equipped with a first handle 311 and a second handle 321, which are convenient for lifting the first cylinder 310 and the second cylinder 320 for installation.

The bottom surface of the first cylinder 310 is provided with a first fitting tube 312, the top surface of the second cylinder 320 is provided with an air inlet tube 322, the opening of the air inlet tube 322 is the air inlet 301, the air enters and exits the inner cylinder 302 through the air inlet tube 322.

The inflating and deflating mechanism 300 further comprises a motor barrel 330, a motor 340, and a blade assembly 350. The motor barrel 330 is accommodated in the first cylinder 310, and a second fitting cylinder 331 is provided at the bottom of the motor barrel 330. A second plug-in cylinder 313 is provided in the first cylinder 310. The second fitting cylinder 331 is inserted into the second plug-in cylinder 313, and a first sealing ring 303 is provided therebetween for sealing and connecting them. The top of the motor barrel 330 is provided with a top cover 360, and the periphery of the top cover 360 extends towards the top surface of the second cylinder 320 and is fixedly connected thereto so as to form a blade chamber 361; the blade assembly 350 is accommodated in the blade chamber 361.

The motor 340 is mounted in the motor barrel 330, and a rotating shaft 113 of the motor 340 penetrates through the top cover 360 to mount the blade assembly 350. The blade assembly 350 includes a mounting board 351, the center of the mounting board 351 is provided with an airflow hole 352, and a mounting shaft 353 is arranged in the airflow hole 352. The bottom surface of the mounting board 351 is uniformly provided with several fan blades 354, the blades 354 connect with the mounting shaft 353, the mounting shaft 353 is fixed on the rotating shaft 113 of the motor 340.

When the inflating and deflating mechanism 300 is placed in the outer cylinder 100 in the forward direction, the first cylinder 310 closes to the one-way valve mechanism 200, the second cylinder 320 closes to the lid 110, the first fitting tube 312 inserts into the first inserted tube 120. A second sealing ring 304 is arranged between the outer wall of the first fitting tube 312 and the inner wall of the first inserted tube 120 to connect them in a sealing manner. The top end 101*a* of the outer cylinder 100 is connected to the product to be inflated or deflated; the airflow hole 352 directly faces the air inlet tube 322; and the motor 340 rotates to drive the blade assembly 350 to rotate, so as to extract the air from the product and open the sealing pad 210 by wind pressure to achieve deflation.

A limiting ring 324 is provided in the air inlet tube 322, and the limiting ring 324 is laterally provided with a plurality of side ribs 325 connected to the air inlet tube 322.

Referring to FIG. 8, when the inflating and deflating mechanism 300 is placed in the outer cylinder 100 in the reverse direction, the air inlet tube 322 is inserted into the first inserted tube 120, and the limiting ring 324 pushes the valve cover 240, thereby pushing the valve tube 230 to move away from the valve cover 240 so that the sealing pad 210 on the second end of the valve tube 230 move away from the first inserted tube 120, thereby opening the first inserted tube 120. When the motor 340 rotates and drives the blade assembly 350 to rotate, the air from the outside is sucked into the outer cylinder 100 and inflated the product to be inflated.

An air pressure display screen 400 is arranged between the inner cylinder 302 and the motor barrel 330, and the inner cylinder 302 is provided with a transparent window 201 at a position directly opposite to the air pressure display screen 400, thereby facilitating to observe an air pressure condition in the inner cylinder 30.

The first cylinder 310 and the second cylinder 320 are respectively equipped with switch buttons 105 and 106, which are respectively electrically connected to the motor 340 to control the start and stop of the motor 340, that is, to control the inflating and deflating mechanism 300.

A battery is placed in the integrated inflating and deflating pump and electrically connected to the motor.

A PCB board is placed in the integrated inflating and deflating pump and electrically connected to the motor.

The above content is a further detailed explanation of the present invention in conjunction with specific preferred embodiments, and it cannot be considered that the specific implementation of the present invention is limited to these explanations. For ordinary technical personnel in the technical field to which the present invention belongs, without departing from the concept of the present invention, its architectural form can be flexible and varied, and a series of products can be derived. Just making a few simple deductions or substitutions should be considered as belonging to the scope of patent protection of the present invention determined by the submitted claims.

The invention claimed is:

1. An integrated inflating and deflating pump, comprising:

an outer cylinder;

a one-way valve mechanism, arranged at a bottom of said outer cylinder; and, an inflating and deflating mechanism, placed in said outer cylinder in a forward or reverse direction;

said outer cylinder is connected to a product to be inflated or deflated; said inflating and deflating mechanism has an air inlet; when said inflating and deflating mechanism is placed in said forward direction, said air inlet is close to said product, said inflating and deflating mechanism extracts air from said products to achieve deflation; when said inflating and deflating mechanism is placed in said reverse direction, said air inlet is close to said one-way valve mechanism, said one-way valve mechanism is opened, said outer cylinder is in communication with an outside, and said inflating and deflating mechanism fills said product with air from the outside to achieve inflation;

said bottom surface of said outer cylinder protrudes inwards to form a first inserted tube, said one-way valve mechanism is mounted in said first inserted tube and comprises a sealing pad, hermetically sealed said first inserted tube so as to isolate an inner cavity of said outer cylinder from said outside, or open said first inserted tube so as to communicate said inner cavity of said outer cylinder with said outside.

2. The integrated inflating and deflating pump according to claim 1, wherein said one-way valve mechanism further comprises a mounting seat, a valve tube with a first end and a second end, a valve cover, a valve rod, and a spring; said mounting seat is connected with said first inserted tube by several connecting ribs, said valve tube extends into said outer cylinder through said mounting seat in a sliding manner, said first end thereof is plugged with said valve cover, and said second end thereof is plugged with said valve rod; an end of said valve rod is provided with said sealing pad, and said valve tube is sleeved with said spring; one end of said spring abuts against said mounting seat and the other end thereof abuts against said valve cover.

3. The integrated inflating and deflating pump according to claim 2, wherein said second end of said valve tube laterally extends several ribs to connect with a circle, when said sealing pad abuts against said ribs and said circle, said sealing pad is blocked.

4. The integrated inflating and deflating pump according to claim 2, wherein said valve rod is provided with a limiting ring, said second end of said valve tube is provided with a through hole for said valve rod to pass through, an outer diameter of said limiting ring is bigger than an inner diameter of said through hole, when said valve rod moves until said limiting ring abuts against said through hole, said limiting ring is blocked by said second end of said valve tube and cannot be detached from said through hole, thereby preventing said valve rod from falling out of said valve tube.

5. The integrated inflating and deflating pump according to claim 1, wherein said inflating and deflating mechanism includes an inner cylinder comprising a first cylinder and a second cylinder that are interlocked with each other;

a bottom surface of said first cylinder is provided with a first fitting tube, a top surface of said second cylinder is provided with an air inlet tube, an opening of said air inlet tube is said air inlet, said air enters and exits said inner cylinder through said air inlet tube;

said inflating and deflating mechanism further comprises a motor barrel, a motor, and a blade assembly; said motor barrel is accommodated in said first cylinder, said motor is mounted in said motor barrel, and a second fitting cylinder is provided at said bottom of said motor barrel;

a second plug-in cylinder is provided in said first cylinder, said second fitting cylinder is inserted into said second plug-in cylinder, and a first sealing ring is provided therebetween for sealing and connecting said second fitting cylinder and said second plug-in cylinder; a top of said motor barrel is provided with a top cover, and a periphery of said top cover extends towards a top surface of said second cylinder and is fixedly connected thereto so as to form a blade chamber; said blade assembly is accommodated in said blade chamber; and a rotating shaft of said motor penetrates through said top cover and used for mounting said blade assembly.

6. The integrated inflating and deflating pump according to claim 5, wherein said blade assembly includes a mounting board, a center of said mounting board is provided with an airflow hole, a mounting shaft is arranged in said airflow hole; a bottom surface of said mounting board is uniformly provided with several blades, said blades connect with said mounting shaft, said mounting shaft is fixed on said rotating shaft of said motor.

7. The integrated inflating and deflating pump according to claim 6, wherein when said inflating and deflating mechanism is placed in said outer cylinder in said forward direction, said first fitting tube is inserted into said first inserted tube, a second sealing ring is arranged between an outer wall of said first fitting tube and an inner wall of said first inserted tube to connect them in a sealing manner; said airflow hole directly faces said air inlet tube; and said motor rotates to drive said blade assembly to rotate so as to extract said air from said product.

8. The integrated inflating and deflating pump according to claim 5, wherein a limiting ring is provided in said air inlet tube, and said limiting ring is laterally provided with a plurality of side ribs connected to said air inlet tube; when said inflating and deflating mechanism is placed in said outer cylinder in said reverse direction, said air inlet tube is inserted into said first inserted tube, and said limiting ring pushes said valve cover, thereby pushing said valve tube away from said valve cover so that said sealing pad on said second end of said valve tube moves away from said first inserted tube, thereby opening said first inserted tube; when said motor rotates and drives said blade assembly to rotate so as to suck said air from said outside into said outer cylinder and inflate said product.

9. The integrated inflating and deflating pump according to claim 5, wherein an air pressure display screen is arranged between said inner cylinder and said motor barrel, and said inner cylinder is provided with a transparent window at a position directly opposite to said air pressure display screen, thereby facilitating to observe an air pressure condition in said inner cylinder.

* * * * *